United States Patent [19]

Spears

[11] 4,019,656

[45] Apr. 26, 1977

[54] COLLAPSIBLE TUBE SQUEEZING DEVICE

[76] Inventor: Cecil Julius Spears, 112 McFarland Road, Enfield, N.C. 27823

[22] Filed: Apr. 26, 1976

[21] Appl. No.: 680,280

[52] U.S. Cl. ..... 222/103

[51] Int. Cl.[2] ..... B65D 35/28

[58] Field of Search ..... 222/103, 105

[56] References Cited

UNITED STATES PATENTS

| | | | |
|---|---|---|---|
| 1,320,275 | 10/1919 | Roach | 222/103 |
| 2,678,755 | 5/1954 | Buras, Jr. | 222/103 |
| 3,949,744 | 4/1976 | Clarke | 222/103 |

FOREIGN PATENTS OR APPLICATIONS

| | | | |
|---|---|---|---|
| 1,159,246 | 6/1958 | France | 222/103 |
| 451,933 | 8/1936 | United Kingdom | 222/103 |
| 285,745 | 2/1928 | United Kingdom | 222/103 |

*Primary Examiner*—Stanley H. Tollberg
*Assistant Examiner*—Hadd Lane
*Attorney, Agent, or Firm*—Harold L. Stowell

[57] ABSTRACT

A collapsible tube squeezing device comprises a pair of matching jaws pivotally connected at one end with matching handles at the other end, and a resilient spring for retaining the jaws in a closed position. A collapsible tube zone defined by contact faces of the jaws which are provided with a roughened surface to frictionally engage a collapsible tube. The pivotal end of one of the jaws is bevelled to permit opening and closing of the tube squeezer device and for gripping the crimped end of a collapsible tube to retain it between the jaws.

4 Claims, 3 Drawing Figures

38
2
10
14
36
40
50
A
20
52
36
32
28
24
18
12
2
20
34
16

10
26
14
30
20
28
24
18
40
16
12

18
10
14
30
50
40
22
20
A
52
16
24
28
12

COLLAPSIBLE TUBE SQUEEZING DEVICE

CROSS REFERENCE TO RELATED PATENTS AND APPLICATIONS

Related subject matter is disclosed and claimed in my co-pending applications, Ser. Nos. 500,444, filed Aug. 26, 1974, now U.S. Pat. No. 3,970,220 of July 20, 1976, and Ser. No. 628,781, filed Nov. 4, 1975, now U.S. Pat. No. 3,961,727 of June 8, 1976.

BACKGROUND OF THE INVENTION

Collapsible tube squeezing devices for dispensing the contents of tubes containing toothpaste, haircream, hand-lotion, shoe polishing cream, glue, and the like, are well known in the art. A review of the prior art devices shows that while such devices exist they have not received substantial user acceptance due to their expense, size, lack of universal utility, difficulty with operation and the necessity to use both the operator's hands in emptying the contents of collapsible tubes.

The advent of collapsible tubes formed of plastic, rather than the well-known metallic type collapsible tube, has also presented additional problems which have rendered many pre-plastic tube squeezing devices unusuable for their intended purposes, particularly in regard to removal of the contents of the crown portion of such tubes. Crown portions of plastic collapsible tubes have a tendency to be substantially more rigid than crowns of metallic tubes.

SUMMARY OF THE INVENTION

It is a particular object of the present invention to provide a collapsible tube squeezing device which will accommodate a large variety of sizes of collapsible tubes in a relatively inexpensive, simple-to-operate, collapsible tube squeezing device which is particularly adapted to remove the contents of both metallic and plastic forms of tubes.

Another object of the present invention is to provide such a device which is relatively compact in size and may be operated with one hand and with the base of the device aligned in substantially any plane, that is, the provision of a tube-squeezing device which is not direction-sensitive.

It is a further object of the present invention to provide such a device which may be cast, molded, stamped, or formed from plastic, wood, metal, or combinations thereof.

In general, the present invention comprises a collapsible tube squeezing device comprising a pair of jaw members, means of mounting said jaw members to receive a collapsible tube therebetween including:

a. a pair of jaw members pivotally connected at one end and having operating handles at the other end offset to one side of the jaws so as not to interfere with dispensing the content of a collapsible tube, b. one of the jaw members having a bevelled surface at its pivotal end to allow uniform surface contact between the contact faces of the jaws and to cooperate with the other jaw to grip the crimped end of a collapsible tube.

c. a roughened surface on the contact faces of the jaw members to frictionally support a collapsible tube, and d. a resilient member normally urging the jaw members into the closed position.

A BRIEF DESCRIPTION OF THE DRAWING

The invention will be more particularly described in reference to the accompanying drawing wherein.

Figure 1:
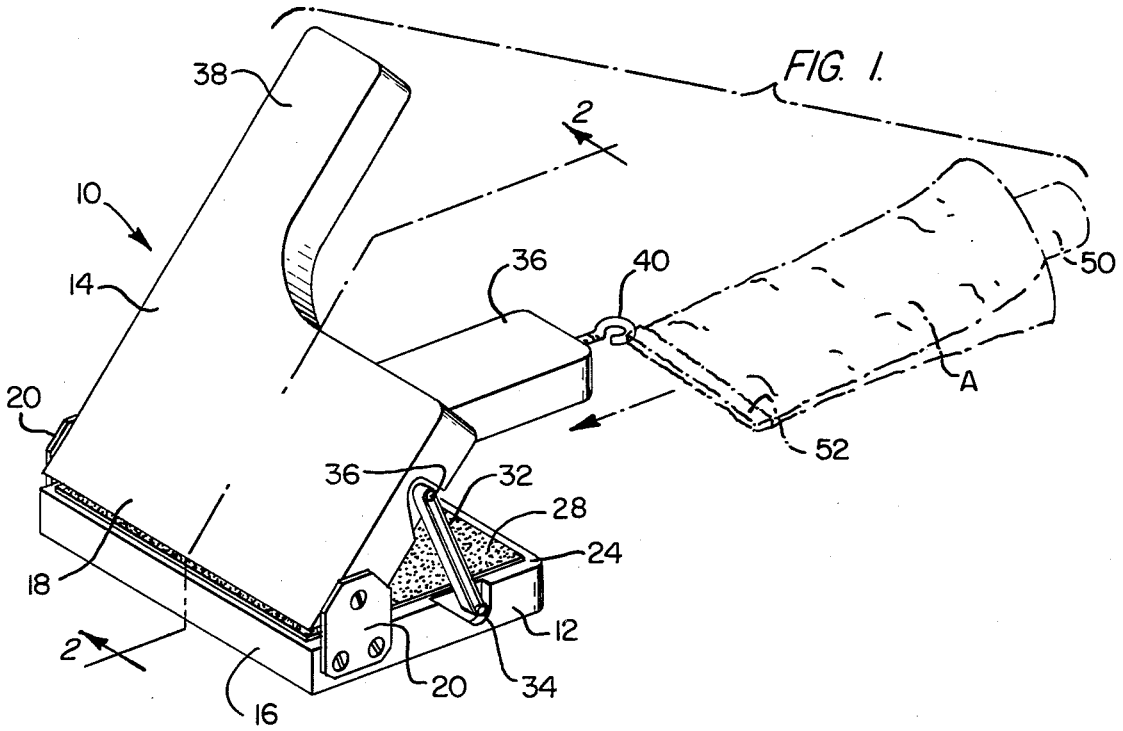
FIG. 1 is a perspective view of the collapsible tube-squeezing device of the present invention.

Referring now to FIGS. 1–3, 10 generally designates a form of the improved tube-squeezing device and includes a first jaw member 12 and a second jaw member 14. The pair of jaw members 12 and 14 are pivotally connected adjacent the rearward end 16 of jaw member 12 and 18 of jaw member 14 by a pair of links 20 with one link on each side of the jaw members. The pair of links are rigidly attached to jaw member 12 and pivotally attached to jaw member 14.

Figure 3:
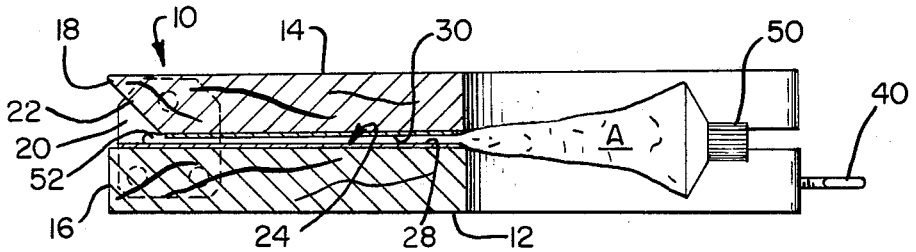

The rearward end 18 of jaw member 14 has a bevelled surface at 22 to allow the jaws to open wider and close more uniformly along faces 24 and 26. Further, the bevelled surface 22 functions to cooperate with surface 24 of jaw member 12 to grip a collapsible tube A, as shown in FIG. 3.

The faces 24 and 26 of jaw members 12 and 14, respectively, have roughened surfaces 28 and 30, respectively, to frictionally grip the collapsible walls of tube A. These roughened surfaces 28 and 30 can either comprise a coating containing friction material, or a glued-on material such as sandpaper. A coating such as synthetic plastic or rubber composition mixed with sand, metallic particles, or the like, will provide satisfactory results. In place of the sandpaper strip, a sheet of rubber having frictional material imbedded therein will also work well.

Jaw members 12 and 14 are biased closed or against the collapsible walls of a tube A by an elastic rubber band 32, wrapped around posts 34 and 36. In place of the elastic rubber band 32, other types of resilient biasing elements such as springs and the like can be used with substantially equal success. Further a second resilient biasing element can be attached to the other side walls of the jaw members.

Each of the jaw members 12 and 14 has an operating handle 36 and 38, respectively, which cooperate in applying pressure to the collapsible tube. The operating handles extend along one side to not interfere with the tube dispensing operation. On one of the operating arms, there is a closed screw in eye through which a neck chain can be attached for easy carrying of the tube-squeezing device.

Figure 2:
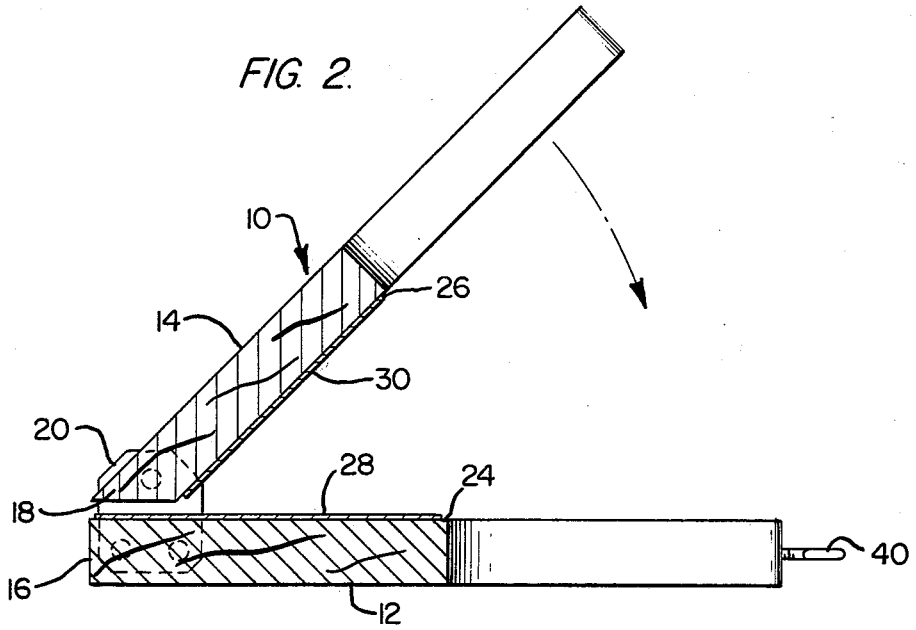
FIG. 2 is a section through the structure shown in FIG. 1 along the line 2—2; and, FIG. 3 is a view like FIG. 2 showing the tube-squeezing device with the jaw members in the closed position and a tube in the operative position.

In operation of the invention, shown in FIGS. 1–3, the handles 36 and 38 are spread apart as shown in FIGS. 1 and 2 creating a gap between the jaws 12 and 14 and a collapsible tube, such as tube A, is inserted between the jaws with the outlet end with cap 50 adjacent the forward end of the jaw members. The collapsible tube A extends into the jaws to where the bevelled surface 22 of jaw 14 contacts crimped edges 52 of the collapsible tube and the roughened surfaces 28 and 30 frictionally engage the tube walls. The band 32 gently closes the jaw members against the tube walls without dispensing any of the tube's contents. Then, with the cap removed from the tube, hand pressure applied to the handles 36 and 38 causes the two jaws to be moved toward each other closing the gap therebetween and forcing the contents from the outlet end of the collapsible tube A.

It will be noted in FIG. 3 that as the jaws move toward each other closing the gap therebetween, bevelled surface 22 allows more complete and uniform squeezing of the tube's walls. As the tube empties of its contents the sealed crimped end of the tube can be rolled on itself when the jaw members are opened and the collapsible tube is moved further in between the jaws.

The apparatus hereinbefore described may be constructed of metal, plastic, wood, ceramic, or other combinations thereof as long as the material of construction has sufficient strength to perform its intended function and experiments have shown that the device is equally satisfactory when squeezing the contents from plastic or metal foil collapsible tubes.

From the foregoing description, it will be recognized by those skilled in the art that various modifications of the improved collapsible tube-squeezing device may be devised without departing from the scope of the intended claims.

I claim:

1. A collapsible tube-squeezing device comprising a pair of pivotal substantially planar jaw members, each of said substantially planar jaw members having a front edge and a rear edge to receive a portion of a collapsible tube therebetween said jaw members including:

a. a bevelled surface along the rear edge of one of the said jaw members;

b. a pair of links;

c. one of each of the pair of links being secured to the side edges of the other of the jaw members adjacent the rear edge;

d. pivot pin means pivotally connecting the said one jaw member to said pair of links with the bevelled edge generally directed toward the other of the jaw members;

e. a pair of operating handles, one of said handles being attached to each of said jaw members and off-set to one side of the front edges and extending forwardly of the collapsible tube receiving portions of the jaw members, said off-set handles cooperating with each other in applying pressure between said jaw members; and, f. resilient means urging said jaw members into a closed position and wherein said bevelled surface cooperates with the other jaw member to grip the sealed edge of a collapsible tube.

2. The invention defined in claim 1, including roughened opposed faces on said jaw members.

3. The invention defined in claim 2 wherein said roughened faces are sandpaper strips adhesively bonded to said jaw members.

4. The invention defined in claim 1 wherein said resilient means is a rubber band.

* * * * *